United States Patent [19]

Hafner

[11] Patent Number: 4,896,414

[45] Date of Patent: Jan. 30, 1990

[54] WATERPROOF CUT AND DISPLACE JOINT AND METHOD FOR MAKING SAME

[76] Inventor: Otto P. Hafner, 1321 Paddock Way, Cherry Hill, N.J. 08034

[21] Appl. No.: 145,910

[22] Filed: Jan. 20, 1988

[51] Int. Cl.[4] ..... B21D 39/00; B23P 11/00

[52] U.S. Cl. ..... 29/432.1

[58] Field of Search ..... 29/243.53, 432.1, 432.2, 29/521; 403/285

[56] References Cited

U.S. PATENT DOCUMENTS

| | | | |
|---|---|---|---|
| 3,534,466 | 10/1970 | Ardolino et al. | 29/509 |
| 3,599,318 | 8/1971 | Behlem | 29/509 |
| 3,729,804 | 5/1973 | Middleton | 29/432 |
| 3,771,216 | 11/1973 | Johnson | 29/243.53 |
| 3,828,517 | 8/1974 | Johnson | 52/758 |
| 3,900,937 | 8/1975 | Schleicher | 29/521 X |
| 3,919,955 | 11/1975 | DuVernay | 29/432.2 |
| 4,035,901 | 7/1977 | Lux | 29/243 |
| 4,059,897 | 11/1977 | Marquis | 29/432 |
| 4,174,559 | 11/1979 | Persik et al. | 29/509 |
| 4,306,511 | 12/1981 | Ashby et al. | 113/1 |
| 4,403,409 | 9/1983 | Richards | 29/521 X |
| 4,459,735 | 7/1984 | Sawdon | 29/243.53 |
| 4,531,279 | 7/1985 | Gunter | 29/243.53 |
| 4,584,753 | 4/1986 | Eckold et al. | 29/243 |
| 4,614,017 | 9/1986 | Eckold et al. | 29/243 |

*Primary Examiner*—Timothy V. Eley
*Attorney, Agent, or Firm*—Austin R. Miller

[57] ABSTRACT

Deformable sheets are mechanically joined by punching and deforming the sheets in such a manner that one sheet is partially severed and the other sheet is correspondingly deformed without being severed. Pressure is applied to the joint, at least partially flattening both of the deformed portions of the sheets, outwardly expanding the partially severed portion of the severed sheet causing its severed edges to extend outwardly beyond the deformed but unsevered edges of the other sheet, thereby locking the sheets together to produce a waterproff sealed joint.

4 Claims, 5 Drawing Sheets

WATERPROOF CUT AND DISPLACE JOINT AND METHOD FOR MAKING SAME

BACKGROUND OF THE INVENTION

This invention relates to mechanically connecting together metal sheets, particularly to a waterproof cut and displace joint and a method for forming the same.

DISCUSSION OF THE PRIOR ART

It is known in the art to join together two sheets of material without utilization of welds, adhesives, fasteners and the like. Attempts have been made to lance, punch, deform, bend and cut such sheets to form joints. Such attempts include, for example, the following U.S. Pat. Nos. 3,470,596, 3,791,016, 3,900,937, 4,403,409, 4,501,356, 4,459,735, 4,531,279, 4,569,111 and 4,658,502.

U.S. Pat. Nos. 4,607,418 and 3,726,000, issued to and owned by the inventor hereof, disclose joints wherein portions of two sheets of material are displaced and cut from the sheets. Both displaced portions are then flattened by opposing punches. These joints have proven to be quite effective for utilization in situations not calling for waterproof joints.

OBJECTS OF THE INVENTION

It is an object of the invention to provide a waterproof joint and a method of joining together two metal sheets in a manner that the sheets are tightly and securely interlocked.

It is another object of the invention to provide a joint and a method of joining together two metal sheets which does not require extraneous joining materials such as adhesives or fasteners and which does not change the characteristics of the sheets such as by welding.

It is yet another object of the invention to provide a joint and a method of joining together two metal sheets which are impervious to the penetration of fluids so as to prevent fluid leakage.

Other objects and advantages of the invention will become apparent to those skilled in the art from the drawings, the detailed description of preferred embodiments and the appended claims.

SUMMARY OF THE INVENTION

This invention provides a method of mechanically joining together sheet members having portions lying in substantially parallel planes adjacent to each other. The method includes deforming a portion of the first metal sheet into the second metal sheet such that two side edges of the deformed portion are severed from the first sheet and two end edges of the deformed portion remain attached to the first sheet. Further, an adjacent and corresponding portion of the second sheet is caused to deform away from the first sheet in response to deformation of the first sheet. The portion of the second sheet being deformed is displaced but not severed along its two side edges and two end edges.

Force is then applied to the deformed portion of the second sheet in the direction of the first sheet by a ram. At the same time, a counter force is maintained against the deformed portion of the first sheet by a punch, which results in a pushing force by the deformed portion of the first sheet against the deformed portion of the second sheet. This flattens both of the deformed portions and causes them to expand outwardly along a plane generally parallel to the planes of the sheets. Outward expansion of the deformed portion of the first sheet results in the severed side edges extending outwardly beyond the deformed but not severed side edges of the deformed portion of the second sheet, thereby locking the sheets together. The pushing force also serves to push the deformed portion of the first sheet into the deformed portion of the second sheet to further lock the sheets together.

This invention further provides a waterproof joint connecting together two sheets having adjacent surfaces facing each other. The joint includes a portion of the first sheet deformed into the second sheet such that two side edges of the deformed portion are severed from the first sheet and two end edges of the deformed portion remain attached to the first sheet, and wherein a portion of the second sheet adjacent the deformed portion of the first sheet is deformed away from the first sheet, but is not severed along its side edges or end edges.

Both of the deformed portions have thicknesses less than the thicknesses of their corresponding sheets, with the distance between the two side edges of the first deformed portion being greater than the distance between two corresponding side edges in the first sheet formed by the severance of the first deformed portion along the two side edges.

The resulting joint is strong, waterproof and resistant to opening up even when subjected to repeated stresses.

DETAILED DESCRIPTION OF THE INVENTION

Figure 2:
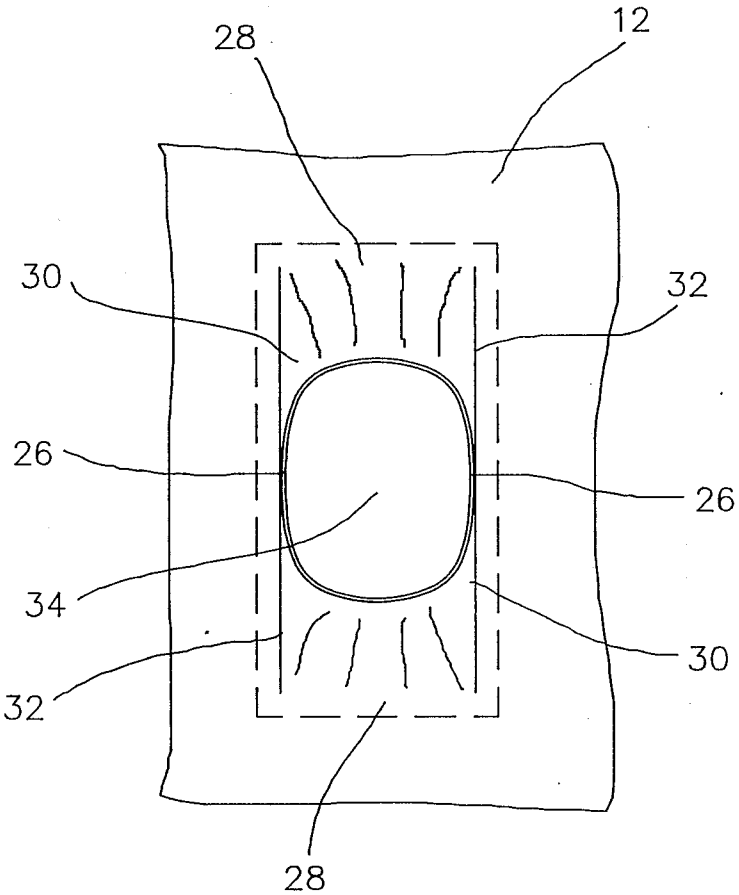
FIG. 2 shows a bottom plan view of the joint illustrated in FIG. 1.

Although a particular form of apparatus and method has been selected for illustration in the drawings, and although specific terms will be used in the specification, for the sake of clarity in describing the apparatus and method steps shown, the scope of this invention is defined in the appended claims and is not intended to be limited either by the drawings selected or the terms used in the specification or abstract.

Figure 1:
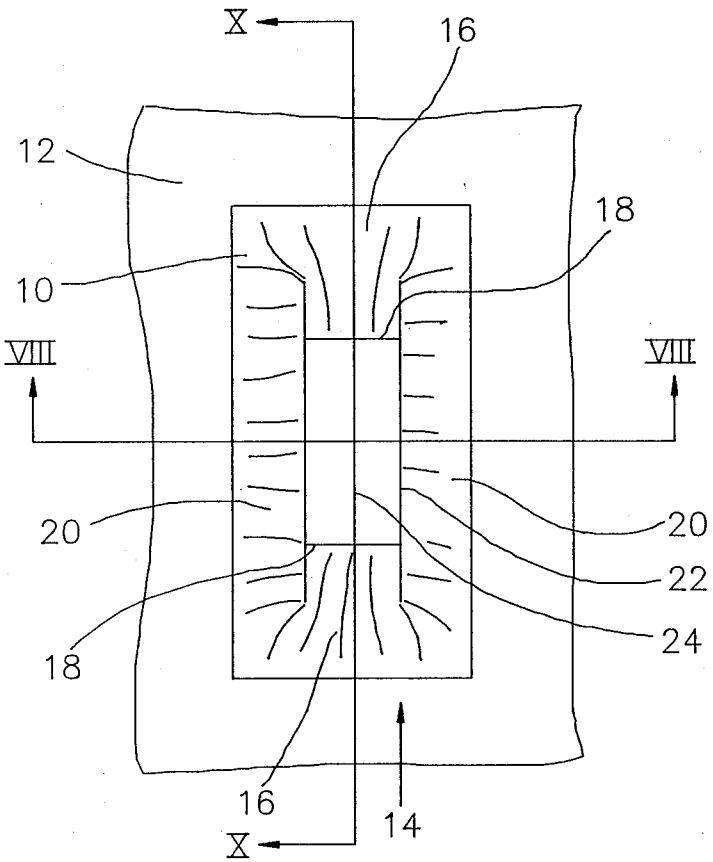
FIG. 1 shows a top plan view of a joint formed in accordance with the invention joining together two sheets of material.

As shown in FIG. 1, which is a plan view, an upper sheet 10 is joined to a lower sheet 12 by a joint 14 of the invention. Upper sheet 10 has a pair of downwardly deformed opposed areas 16, 16 which lead to deformed but not cut end edges 18. Similarly, upper sheet 10 further has downwardly deformed regions 20 which terminate as a pair of opposed cut side edges 22, 22. Accordingly, the partially cut and displaced portion 24 lies below the plane of lower sheet 12 and is connected to upper sheet 10 by way of downwardly deformed but uncut opposed areas 16, 16.

In FIG. 2, which is a bottom view, it is shown that each of a pair of opposed deformed portions 26, 26 connects to lower sheet 12 by way of a pair of opposed bridge ends 28, 28 and extensions 30, 30. Die opening side lines 32 indicate the boundary between extension bridges 30 and lower sheet 12. Deformed portion 26 has a flattened face 34 on its exposed bottom surface.

Figure 3:
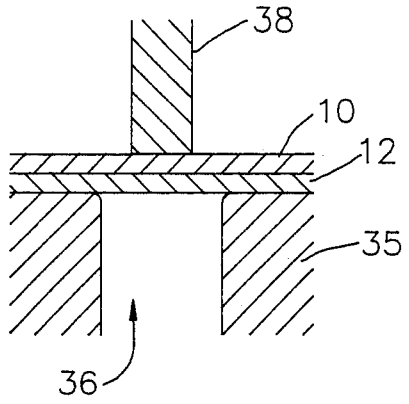
FIG. 3 is a side cross sectional view of a punch and die and two sheets of material prior to cutting and displacement.
Figure 4:
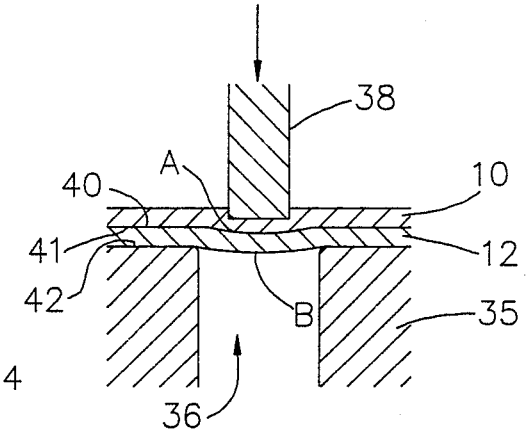
FIG. 4 is a side cross sectional view of one stage of operation of the apparatus of FIG. 3, showing the two sheets of material undergoing cutting and displacement in accordance with one step of the method of the invention.

The nature and structure of the novel joint according to this invention will be further understood with respect to the manner in which it was made. FIG. 3 shows upper sheet 10 and lower sheet 12 lying adjacent one another in parallel planes on a die 35 having a die opening 36. Punch 38 contacts upper sheet 10. In FIG. 4, upper and lower sheets 10 and 12 remain on die 35. Punch 38, moving downwardly in the direction indicated by the arrow extends partially into upper sheet 10. Undersurface 40 of upper sheet 10 is slightly deformed at point A and topsurface 41 of lower sheet 12 is also slightly deformed. Undersurface 42 of lower sheet 12 is minimally deformed at point B.

Figure 5:
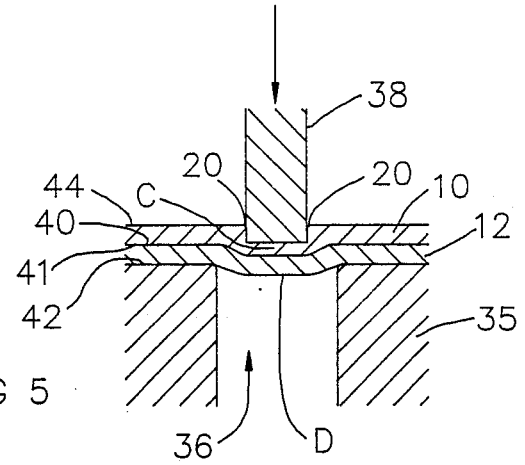
FIG. 5 shows a further step of cutting and displacement.

FIG. 5 shows punch 38 extending further into upper sheet 10. Upper sheet 10 is substantially deformed along undersurface 40 and at point C, as is topsurface 41 of lower sheet 12. Topsurface 44 of upper sheet 10 is also slightly deformed at downwardly deformed regions 20. Undersurface 42 of lower sheet 12 is slightly deformed at point D.

Figure 6:
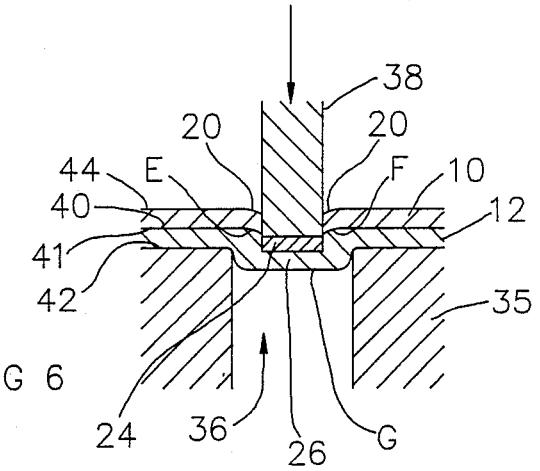
FIG. 6 shows yet a further step of cutting and displacment.

Punch 38 extends completely through upper sheet 10 in FIG. 6. Cut and displaced portion 24 resides within the plane of lower sheet 12. Downwardly deformed regions 20 have deformed further downwardly as has undersurface 40 of upper sheet 10 at points E and F. Deformation of topsurface 41 of lower sheet 12 is similar to that of undersurface 40. Undersurface 42 and deformed portion 26 of lower sheet 12 are deformed into the die opening 36 at point G due to the presence of cut and displaced portion 24 within the plane of lower sheet 12.

Figure 7:
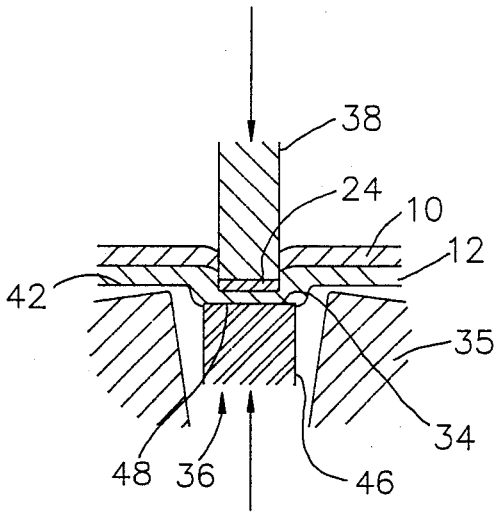
FIG. 7 shows still a further step of cutting and displacement subsequent to that shown in FIG. 6.

FIG. 7 is similar to FIG. 6 except that ram 46 extends upwardly through die opening 36 as indicated by the lower arrow and into contact with the undersurface 42 of lower sheet 12. End surface 48 of ram 46 extends beyond under surface 42 into the body of deformed portion 26 and the resulting opposing forces act to form flattened face 34 and the die 35 has also split into its respective halves.

Figure 8:
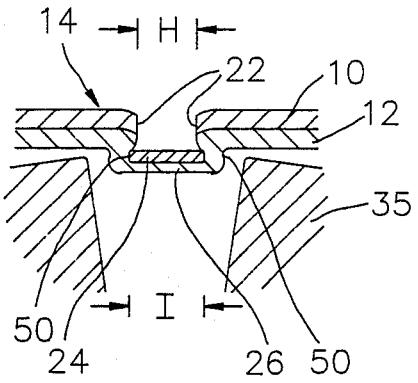
FIG. 8 shows a cross sectional view of a completely formed joint formed in accordance with the invention taken along the lines and arrows VIII—VIII shown in FIG. 1.
Figure 9:
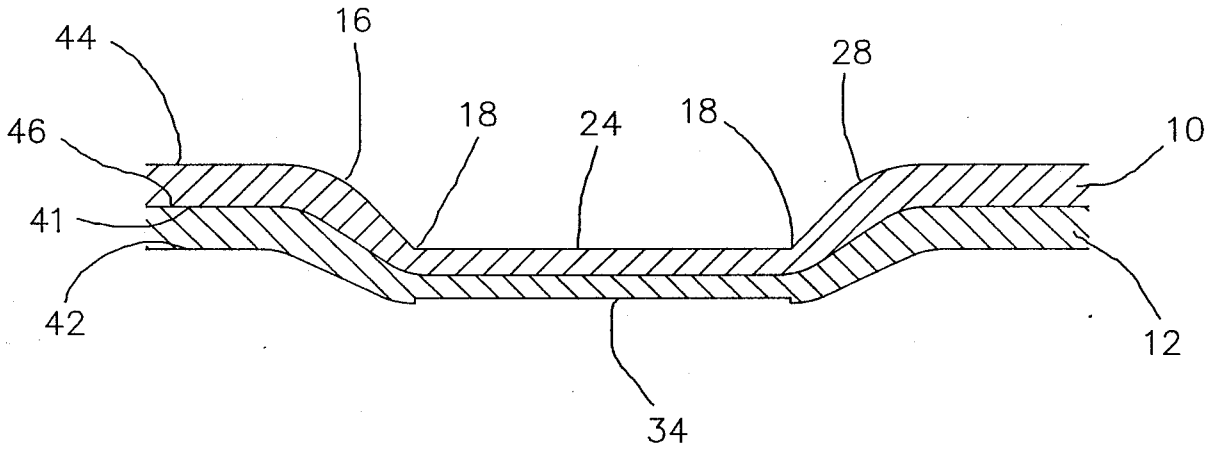
FIG. 9 shows a cross sectional view of a completely formed joint formed in accordance with the invention taken along the lines and arrows IX—IX shown in FIG. 1.

FIGS. 8 and 9 show a fully formed joint 14 produced in accordance with the invention. Punch 38 and ram 46 have been withdrawn and no longer contact upper and lower sheets 10 and 12. Cut and displaced portion 24 has a thickness less than the thickness of upper sheet 10 and deformed portion 26 has a thickness less than the thickness of lower sheet 12. In FIG. 8, the distance between cut side edges 22 as shown by the letter H is less than the distance between corresponding side edges 50 on cut and displaced portion 24 as shown by the letter I.

Referring to the drawings in general, one method of forming a joint in accordance with the invention is outlined below. Joint 14 is formed from upper sheet 10 and lower sheet 12 by mechanical deformation and punching. Sheets 10 and 12 are placed on die 35 to extend completely over die opening 36. The edges of die 35 that form die opening 36 are rounded to prevent unwanted cutting of lower sheet 12. Punch 38 is suspended over die opening 36 and moves downwardly into contact with upper sheet 10 as depicted in FIG. 3. Punch 38 continues to move downwardly, causing both sheets 10 and 12 to deform. Punch 38 begins to cut into upper sheet 10 and deform it downwardly into lower sheet 12 as illustrated at point A in FIG. 4. Lower sheet 12 then begins to deform downwardly into die opening 36 as illustrated at point B.

In FIG. 5, punch 38 continues to simultaneously cut through and deform upper sheet 10 at point C. Lower sheet 12 also further deforms at point D downwardly into die opening 36. Punch 38 eventually severs upper sheet 10 along cut side edges 22, thereby forming cut and displaced portion 24 as illustrated in FIG. 6. However, prior to complete cutting, downwardly deformed regions 20 are formed. Deformed portion 26 has then been completely displaced into die opening 36.

While maintaining punch 38 in a downward position against cut and displaced portion 24, ram 46 moves upwardly against deformed portion 26. Ram end surface 48 contacts undersurface 42 and applies squeezing or flattening pressure so as to reduce the thickness of both cut and displace portion 24 and deformed portion 26. Die 35 is removed or retracted in any manner known in the art to permit lateral expansion of the deformed areas lying below the plane of lower sheet 12. By applying such flattening pressure, cut and displaced portion side edges 50 are caused to move outwardly in a direction parallel to the planar axes of sheets 10 and 12. Pushing force exerted by portion 24 against portion 26 causes portion 24 to expand into portion 26. This has been found to be true even when the sheets have equal softness. As indicated in FIG. 8, the distance between side edges 22 and corresponding edges 50 prior to application of flattening pressure is represented by the arrows H. After application of flattening pressure, the distance between edges 50 on portion 24 has been increased to that indicated by the arrows I. Such an increase in distance, along with the expansion of portion 24 into portion 26, creates a locking effect which prevents cut and displaced portion 24 from separating away from lower sheet 12.

It has been found that the resulting joint 14 exhibits superior locking strength. Pulling sheets 10 and 12 apart is rendered quite difficult by the novel structure of cut side edges 22 overlapping and enclosing edges 50 of cut and displaced portion 24. The locking effect is enhanced by expansion of portion 24 into portion 26. Further, the resulting joint is completely water-proof. While sheet 10 is severed in order to maximize locking capability, sheet 12 is left uncut to insure complete protection against leakage of fluids.

Although this invention has been described in connection with specific forms thereof, it will be appreciated that a wide array of equivalents may be substituted for the specific elements shown and described herein without departing from the spirit and scope of this invention as described in the appended claims.

I claim:

1. In a method of mechanically joining together deformable sheets to form a waterproof sealed joint, the steps comprising:

positioning said sheets with surfaces facing each other;

deforming a portion of a first one of said sheets into the other sheet such that opposed, spaced-apart portions of said first sheet are severed and intervening portions are not severed;

causing an adjacent and corresponding portion of the second sheet to deform without being severed in response to deformation of said first sheet, and compressing said deformed unsevered portion of said second sheet against said first sheet while maintaining resistance against said deformed portion of said first sheet, thereby at least partially flattening both of said deformed portions and causing them to expand outwardly along said sheets, said outward expansion of said deformed portion of said first sheet causing its severed edges to extend outwardly beyond said deformed but unsevered edges of said second sheet, thereby locking said sheets together while maintaining said second sheet deformed but not severed to produce a waterproof sealed joint.

2. A waterproof joint connecting together deformable sheets comprising:

a first one of said sheets having a portion deformed into a second end of said sheets such that opposed, spaced-apart edges of said first deformed portion are severed and intervening portions remain connected to said first sheet; and a second one of said sheets having a portion adjacent said first deformed portion also correspondingly deformed, said deformed portion of said second sheeet being deformed while remaining unsevered, both of said deformed portions having thicknesses less than the thicknesses of their corresponding sheets, and the distance between said opposed, spaced-apart severed edges of said first deformed portion being greater than the distance between the corresponding opposed, spaced-apart severed edges remaining in said first sheet as a result of the severance of said first deformed portion.

3. In a method of mechanically joining together deformable sheets to form a waterproof sealed joint, the steps comprising:

positioning said sheets with surfaces facing each other;

deforming a portion of a first one of said sheets into the other sheet such that opposed, spaced-apart portions of said first sheet are severed and intervening portions are not severed;

causing an adjacent and corresponding portion of the second sheet to deform in response to deformation of said first sheet without being severed, and compressing said deformed portion of said second sheet against said first sheet while maintaining resistance against said deformed portion of said first sheet, thereby at least partially expanding said first deformed and severed portion into said second deformed unsevered portion and at least partially flattening both of said deformed portions and causing them to expand outwardly along said sheets, said outward expansion of said first deformed severed portion causing said severed edges to extend outwardly beyond said deformed but unsevered edges of said second sheet, thereby locking said sheets together while maintaining said second sheet deformed but not severed to produce a water-proof sealed joint.

4. A waterproof joint connecting together deformable sheets comprising:

a first one of said sheets having a portion deformed into a second one of said sheets such that opposed, spaced-apart edges of said first deformed portion are severed and intervening portions remain connected to said first sheet; and a portion of a second one of said sheets adjacent said first deformed portion being deformed away from said first sheet, said deformed portion of said second sheet being deformed but remaining connected, both of said deformed portions having thicknesses less than the thicknesses of their corresponding sheets and said first deformed portion being at least partially expanded into said second deformed portion, and the distance between said opposed, spaced-apart edges of said first deformed and severed portion being greater than the distance between corresponding opposed, spaced-apart edges in said first sheet formed by the severance of said first deformed portion.

* * * * *